US005743483A

United States Patent [19]

Scherer et al.

[11] Patent Number: 5,743,483

[45] Date of Patent: Apr. 28, 1998

[54] ANTI-VIBRATION SYSTEM FOR HIGH SPEED WINDING OF SHEET MATERIAL AND METHOD THEREFOR

[75] Inventors: Philip G. Scherer, Fort Lauderdale; Werner K. Diehl, Parkland, both of Fla.

[73] Assignee: Illinois Tool Works Inc., Glenview, Ill.

[21] Appl. No.: 825,268

[22] Filed: Mar. 27, 1997

[51] Int. Cl.[6] ..... B65H 18/16; B65H 18/26

[52] U.S. Cl. ..... 242/533.6; 242/541.6; 242/547

[58] Field of Search ..... 242/547, 533.6, 242/533.4, 533.5, 541.5, 541.6, 542.2

[56] References Cited

U.S. PATENT DOCUMENTS

| | | | |
|---|---|---|---|
| 3,298,624 | 1/1967 | Schott | 242/547 |
| 4,105,170 | 8/1978 | Schonmeier | 242/541.6 |
| 4,715,552 | 12/1987 | Matsumoto | 242/533.6 |
| 5,054,707 | 10/1991 | Olson | 242/547 |
| 5,226,612 | 7/1993 | Mulfarth | 242/533.6 |

FOREIGN PATENT DOCUMENTS

| | | | |
|---|---|---|---|
| 3637634 | 5/1988 | Germany | 242/547 |
| 62-362259618 | 11/1987 | Japan | 242/547 |
| 402097649 | 4/1990 | Japan | 242/547 |
| 404105712 | 4/1992 | Japan | 242/547 |
| 2136776 | 9/1984 | United Kingdom | 242/547 |

*Primary Examiner*—John M. Jillions
*Attorney, Agent, or Firm*—Donald J. Breh

[57] ABSTRACT

A system and method for controlling vibration of an axially rotatable mandrel useable for winding sheet material including stretch film thereabout. The system includes first, second and third roller members rotatably contactable with the mandrel and sheet material wound thereabout. The roller members are arranged about the mandrel axis so that the mandrel and any sheet material wound about the mandrel is supportably captured between the roller members to prevent or at least substantially reduce vibration of the rotatable mandrel. At least the first and second roller members are biasable toward the mandrel with pneumatic pressure from corresponding air over oil cylinders, and the first and second roller members are movable away from the mandrel against hydraulic resistance from the corresponding air over oil cylinders to accommodate sheet material wound increasingly about the mandrel. In one configuration, first and second mandrels are rotatably coupled to a rotatable turret that alternately positions the mandrels relative to a power driven lay-on roll, wherein each mandrel has at least one corresponding set of first and second roller members which cooperate with the lay-on roll to prevent vibration of the rotating mandrel.

8 Claims, 3 Drawing Sheets

ANTI-VIBRATION SYSTEM FOR HIGH SPEED WINDING OF SHEET MATERIAL AND METHOD THEREFOR

BACKGROUND OF THE INVENTION

The invention relates generally to systems and methods for winding sheet material about a mandrel, and more particularly for reducing vibration of rotatable mandrels having a relatively small diameter, wherein the mandrels are useable for high speed winding of stretch film materials about a film core supported thereby.

The winding of sheet material about a core supported by a rotatable mandrel is known generally and useful in many industries. In one known application, for example, stretch film used for wrapping or packaging purposes is wound about a cardboard core supportably fitted over a rotatable mandrel to form stretch film rolls in a winding operation. Several film cores are typically disposed adjacently about a steel mandrel having an expandable air bladder that outwardly extends engagement members through openings in the mandrel to retain the film cores thereabout. Mandrels of this type are available from Battenfeld Glouchester, Glouchester, Mass. The mandrel is driven rotatably either directly or indirectly to wind a sheet of stretch film often supplied at a constant rate thereabout as discussed further below. The stretch film sheet is separated into several adjacent strips, by slitting during the winding operation, wherein each strip corresponds to one of the film cores thereby forming separate stretch film rolls. In one stretch film winding system used for this purpose, two mandrels are mounted on substantially opposing sides of a rotatable turret that alternately positions the mandrels relative to the stretch film supply, whereby stretch film strips are wound about film cores on one mandrel while the other mandrel is prepared for a subsequent winding operation.

In one mode of winding sheet material, referred to as surface winding, a rotatably driven lay-on roll is disposed axially parallel with the axis of the mandrel and in contact initially with a film core disposed about the mandrel and later with the sheet material wound thereabout for rotatably driving the mandrel to wind the sheet material about the film core. According to this operation, the sheet material, which is usually supplied at a constant rate, is supplied over the lay-on roll, downwardly between the lay-on roll and the mandrel, and under the mandrel whereupon it is wound about the film core. The lay-on roll is thus in direct contact with the surface of the film roll, and is movable, pivotally or otherwise, away from the mandrel as sheet material wound about the mandrel increases in diameter. The rotation rate of the lay-on roll and the mandrel necessarily decreases as the film roll diameter increases in applications where the sheet material is supplied at a constant rate. In some surface winding operations, the mandrel is also driven by auxiliary drive means that operate, not as a primary mover, but merely to reduce drag caused by the mandrel thereby lessening the lead on the lay-on roll. In another mode of winding sheet material, referred to as core winding, the mandrel is rotatably driven directly to wind sheet material about the film core.

The mandrels used presently for winding stretch film about film cores are approximately three inches in diameter and over one-hundred inches in length, and moreover the mandrels rotate at sufficiently high speeds to wind stretch film supplied at constant speeds that may exceed 700 feet per minute. It is desirable in stretch film winding operations, as well as other applications, to reduce the diameter of the mandrels to accommodate smaller size film cores, which have reduced weight, reduced cost and result in smaller size film rolls. But reducing the diameter of such a relatively long mandrel has a tendency to cause uncontrollable vibration of the mandrel during winding operations, particularly at higher winding speeds. The vibration tends to be most severe at resonant frequencies of the mandrels, and depends on some relation between the length, diameter and rotation rate of thereof. The practical effect of reducing the diameter of relatively long mandrels used for winding sheet materials is that the winding rate must be reduced to prevent vibration, which may be destructive to equipment and injurious to personnel. But since reduced winding rates adversely affects productivity, it has heretofore been impractical to realize the benefits of reduced film core size by reducing mandrel diameter.

In view of the discussion above among other considerations, there exists a demonstrated need for an advancement in the art of winding sheet material about a mandrel.

It is therefore an object of the invention to provide novel systems and methods for winding sheet material about a mandrel that overcomes problems with the prior art.

It is also an object of the invention to provide novel systems and methods for controlling vibration of an axially rotatable mandrel useable for winding sheet material including stretch film thereabout, and more particularly for stabilizing long and relatively narrow diameter mandrels rotatable at high speeds.

It is another object of the invention to provide novel systems and methods for stabilizing a rotatable mandrel by supportably capturing, or caging, the mandrel and any sheet material wound thereabout between first, second and third roller members to prevent or at least substantially reduce vibration of the rotatable mandrel, wherein the roller members are retractable away from the mandrel to accommodate sheet material wound increasingly thereabout to form a roll.

It is a more particular object of the invention to provide novel systems and methods for stabilizing a rotatable mandrel by supportably capturing the mandrel between first, second and third roller members, wherein at least the first and second roller members arc biasable toward the mandrel with pneumatic pressure from corresponding air over oil cylinders, and the first and second roller members are movable away from the mandrel against hydraulic resistance from the corresponding air over oil cylinders to accommodate sheet material wound increasingly about the mandrel.

It is yet another object of the invention to provide novel systems and methods for rotatably coupling first and second mandrels to a rotatable turret that alternately positions the mandrels relative to a power driven lay-on roll, which rotatably surface drives the mandrel and sheet material wound thereabout, wherein each mandrel has at least one corresponding set of first and second roller members disposed about an axial segment of the mandrel to cooperate with the lay-on roll for supportably capturing the mandrel therebetween and preventing or at least reducing substantially vibration of the rotating mandrel.

These and other objects, features and advantages of the present invention will become more fully apparent upon consideration of the following Detailed Description of the Invention with the accompanying Drawings, which may be disproportionate for ease of understanding, wherein like structure and steps are referenced by corresponding numerals and indicators.

DETAILED DESCRIPTION OF THE INVENTION

Figure 1:
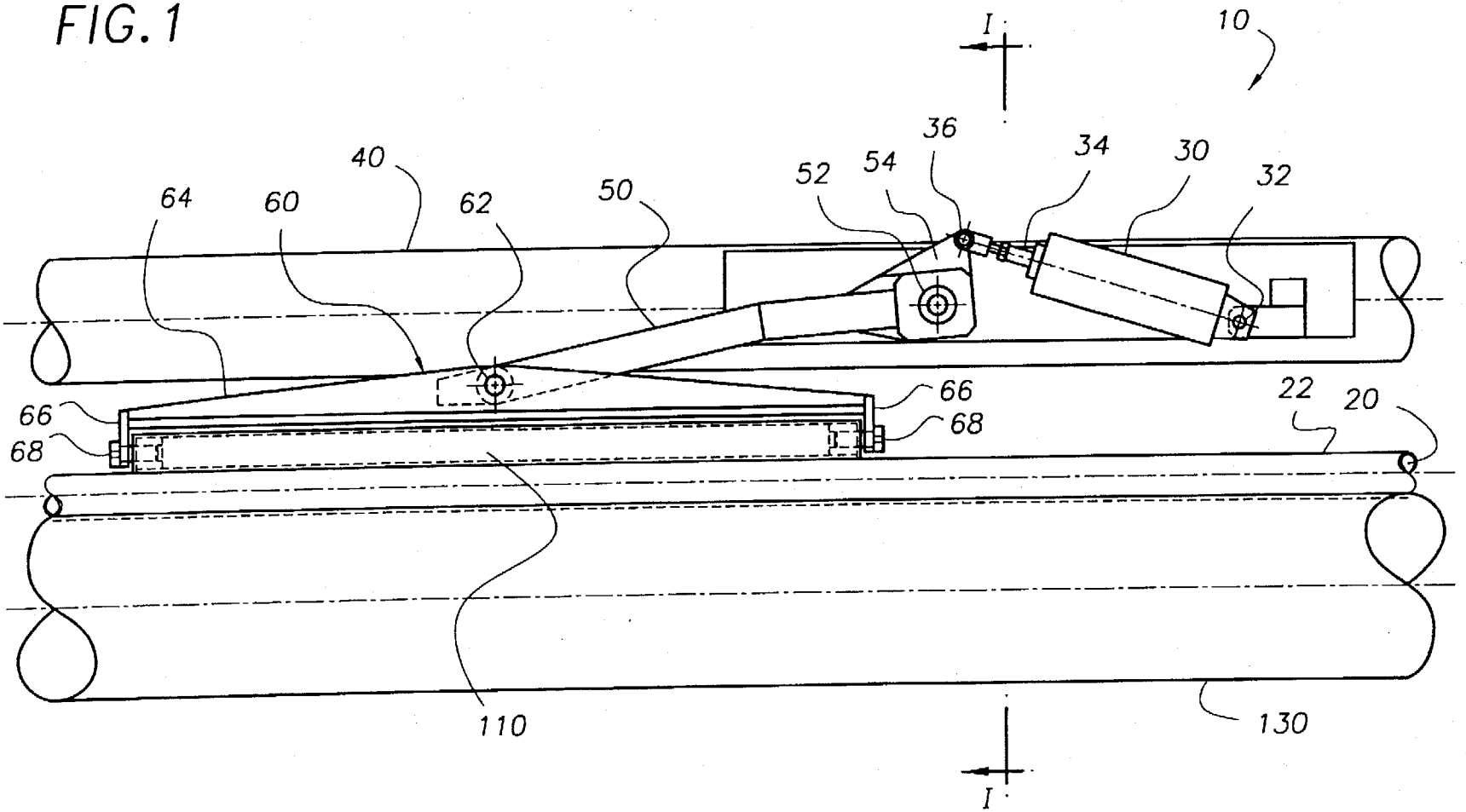
FIG. 1 is a partial top plan view of a system for reducing vibration of an axially rotatable mandrel useable for winding sheet material thereabout according to an exemplary embodiment of the invention.
Figure 2:
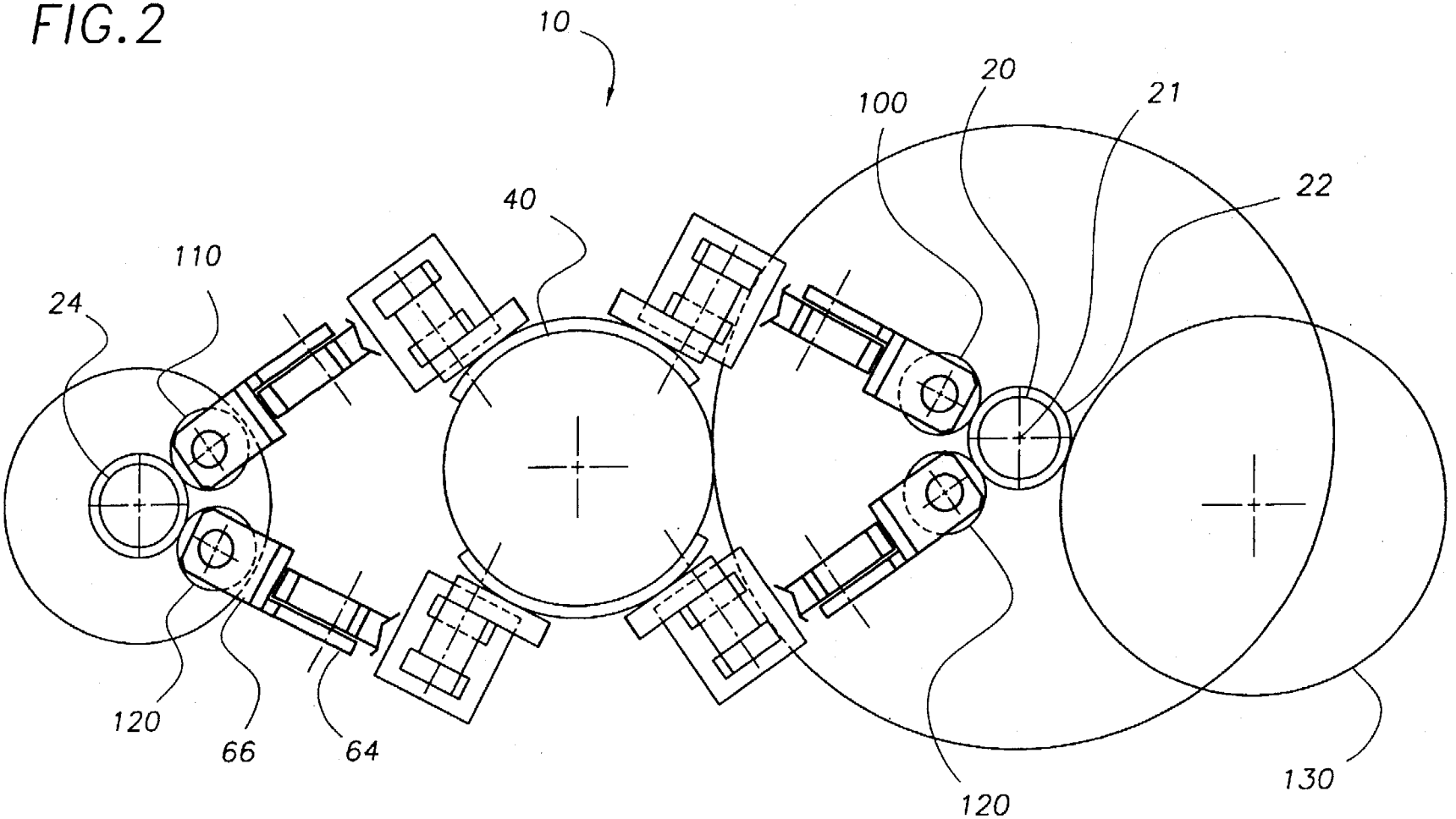
FIG. 2 is a sectional view of a system for reducing vibration of a rotatable mandrel including first and second mandrels rotatably coupled to a rotatable turret, which is representative in part of a sectional view along lines I—I of FIG. 1.

FIGS. 1 and 2 show partial and sectional views of a system 10 for controlling vibration of an axially rotatable mandrel 20 useable generally for winding sheet material, not shown in the drawing, about the mandrel, and more particularly for winding stretch film about one or more cardboard cores 22 disposed and retained about the mandrel 20 as discussed above. In some applications, however, it may be advantageous to wind the sheet material about the mandrel 20 directly without a core 22 therebetween.

FIG. 2 shows the system 10 including generally first, second and third roller members 110, 120 and 130 rotatably contactable with at least one of the mandrel 20 and sheet material wound thereabout. Any reference to the first, second and third roller members being in contact with the sheet material includes contact with the core 22, which may occur initially during winding operations. The first, second and third roller members 110,120 and 130 are arranged about the mandrel axis 21 so that the mandrel 20 and any sheet material wound thereabout is supportably captured therebetween to prevent or at least substantially reduce vibration of the rotatable mandrel 20. The roller members 110, 120 and 130 are thus disposed along different radials of the mandrel axis 21, wherein each radial is separated by some amount of angular measure sufficiently large to capture, or cage, and retain the mandrel therebetween.

In the exemplary embodiment, the first, second and third roller members 110, 120 and 130 are disposed about a common lengthwise axial segment of the mandrel 20 as shown best in FIG. 1. According to this aspect of the invention, the second roller member 120, not visible in FIG. 1, is disposed along the same lengthwise axial segment of the mandrel 20 as the first roller member 110, but along another radial extending from the mandrel axis 21 as shown in FIG. 2. In other embodiments, however, one or more of the first, second and third roller members 110, 120, and 130 may be offset relative to one another lengthwise along the axial dimension of the mandrel 20 to provide more or less overlap therebetween.

Additional sets of first, second and third roller members 110, 120 and 130 may also be arranged similarly about other lengthwise axial portions of the mandrel 20 so that the mandrel and any sheet material wound thereabout is supportably captured between the first, second and third roller members 110, 120 and 130 to prevent or at least substantially reduce vibration along the full length of the rotatable mandrel 20. Generally, the longer the axial dimension of the mandrel 20 and the greater the mandrel rotation rate, the more sets of first, second and third roller members 110, 120 and 130 required to prevent or at least substantially reduce vibration of the mandrel.

In the exemplary embodiment of FIG. 1, the third roller member 130 is a power driven lay-on roll that extends substantially the full axial dimension of the mandrel 20, or at least the width of the supplied sheet material, for rotatably driving the mandrel and any sheet material wound thereabout. The lay-on roll 130 is pivotally mounted and movable away from the mandrel 20 to accommodate increasing amounts of sheet material wound about the mandrel 20, which forms a sheet roll of increasing diameter. According to the exemplary embodiment, additional pairs of first and second roller members 110 and 120 may be arranged along other axial segments of the mandrel 20. In other embodiments, however, the third roller member 130 may be substantially the same as the first and second roller members 110 and 120, and alternatively the mandrel 20 may be rotatably driven by a direct drive member in a core winding configuration.

According to another aspect of the invention shown in the exemplary embodiment of FIG. 1, the first roller member 110 is biasable toward the mandrel 20 with pneumatic pressure from a first air over oil cylinder 30, and the first roller member 110 is movable away from the mandrel against hydraulic resistance from the first air over oil cylinder 30. Similarly, the second roller member 120 is biasable toward the mandrel 20 with pneumatic pressure from a second air over oil cylinder, not shown, and the second roller member 120 is movable away from the mandrel 20 against hydraulic resistance from the second air over oil cylinder. According to this aspect of the invention, pneumatic pressure maintains the first and second roller members 110 and 120 in contact with the mandrel or any sheet material wound thereabout during the winding operation to prevent or at least substantially reduce vibration of the mandrel. As additional sheet material accumulates about the mandrel, the first and second rollers are movable away from the mandrel 20 against hydraulic resistance. The hydraulic resistance of the oil over air cylinder allows the roller member to retract from the mandrel at a very slow rate, which corresponds to the rate at which the wound film roll increases in diameter. At the same time, however, the first and second roller members 110 and 120 are substantially rigid relative to the rotating mandrel 20 and any sheet material wound thereabout thereby supportably capturing or caging the mandrel 20 between the first, second and third roller members to stabilize and prevent destructive vibration of the rotating mandrel. The pneumatic pressure required for biasing the roller members 110 and 120 against the mandrel 20 and any sheet material wound thereabout is thus minimized thereby reducing the likelihood of damage to the wound sheet material resulting from excessive pressure imposed by the roller members.

According to a more specific embodiment of the invention as shown partly in FIG. 1, the first and second roller members 110 and 120 are coupled to a common support member 40 by a corresponding arm 50, only one of which is shown. Each roller member 110 and 120 is mounted in a roller bracket 60 pivotally coupled at 62 to the arm 50, which is pivotally coupled at 52 to the support member 40. The roller bracket 60 includes a gusset 64, extending lengthwise along the roller member, having roller mounts 66 on opposing ends thereof, wherein the corresponding roller member is rotatably coupled to the roller mounts 66 by corresponding roller supports 68. A first end portion 32 of the cylinder 30 is pivotally coupled to the support member 40, and an extendably and retractably actuatable rod 34 of the cylinder 30 is pivotally coupled at 36 to a flange 54 of the arm 50. According to this exemplary embodiment, extension of the rod 34 pivots the arm 50 at pivot 52 to move the roller member 110 toward the mandrel 20, and retraction of the rod 34 counter-pivots the arm 50 to move the roller member 120 away from the mandrel 20. The second roller member 120 is configured similarly, but is not shown in FIG. 1, and in other applications where the third roller member 130 is not a lay-on roll, it too may be configured like the first and second roller members 110 and 120 as discussed herein.

In the embodiment of FIG. 2, the support member 40 is a rotatable turret 40, and the mandrel 20 is one of first and second mandrels 20 and 24 rotatably coupled to the rotatable turret 40, wherein each mandrel 20 and 24 has associated therewith at least one set of first and second roller members 110 and 120 which operate as discussed above. The third roller member 130 in this embodiment is a rotatably powered lay-on roll, which is pivotal toward and away from the mandrel 20 as discussed above for surface driving the mandrel and any sheet material wound thereabout. According to this configuration, the rotatable turret 40 is rotatable to alternately position one of the first and second mandrels 20 and 24 relative to the lay-on roll 130 for driving the selected mandrel to wind sheet material thereabout. Meanwhile the other mandrel is positioned away from the lay-on roll 130 where it may be readied for a subsequent winding operation. For example, a roll of wound sheet material may be removed from the non-selected mandrel, and one or more new film cores 22 may be disposed about the non-selected mandrel for a subsequent winding operation.

Figure 3:
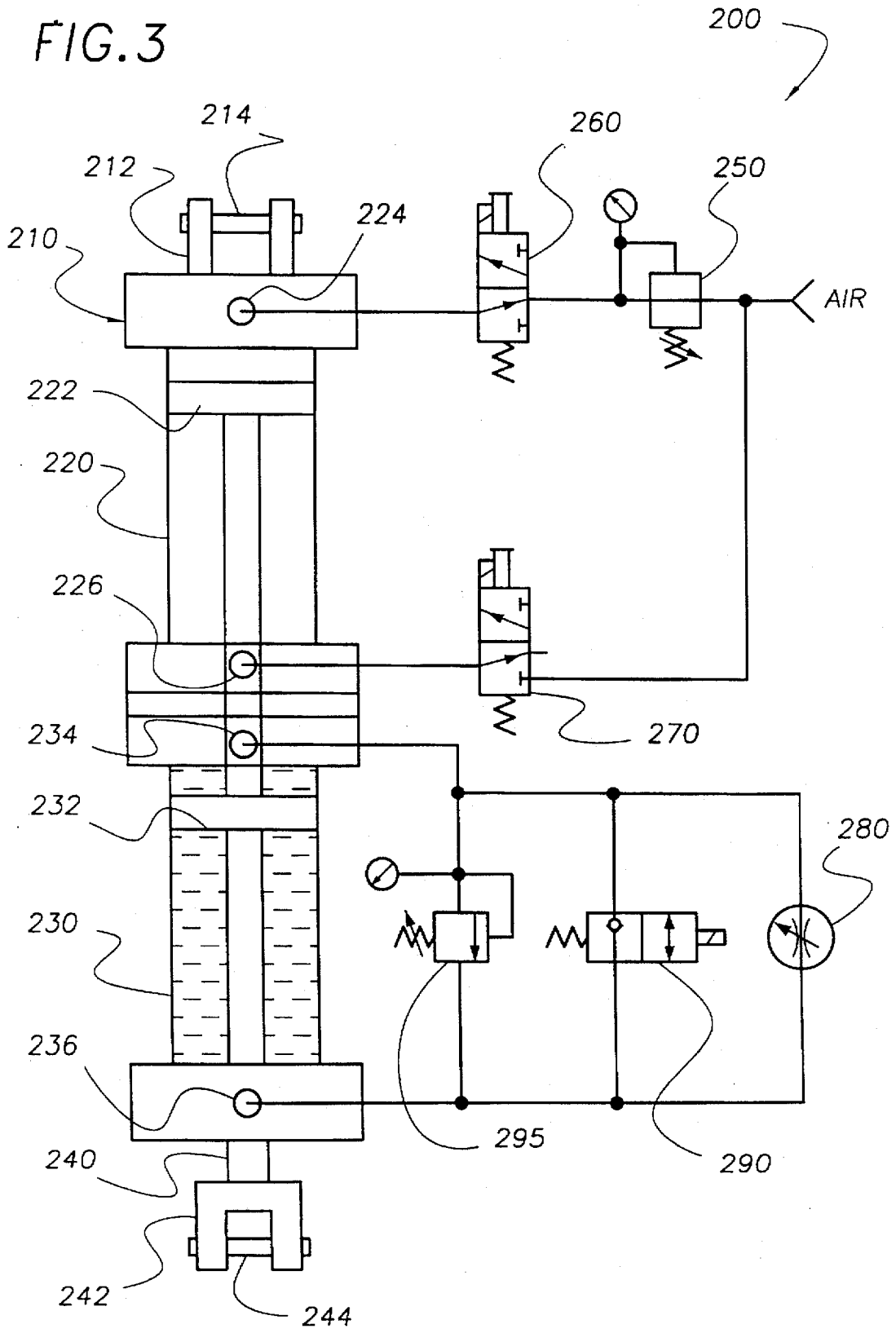
FIG. 3 is a schematic diagram of a fluidic circuit useable in connection with the system of FIGS. 1 and 2 according to an exemplary embodiment of the invention.

FIG. 3 is a schematic diagram of a fluidic circuit 200 useable in connection with the system of FIGS. 1 and 2 according to an exemplary embodiment of the invention. The circuit 200 includes an air over oil cylinder 210, which is the same as cylinder 30 referenced above, having an air cylinder portion 220 and a hydraulic cylinder portion 230, wherein each cylinder has a corresponding piston 222 and 232 coupled to a common actuatable rod 240, which corresponds to the rod 34 above. The cylinder 210 includes a mounting bracket 212 and pin 214 for pivotally coupling the cylinder 210 to the support member 40, and the rod 240 includes a mounting member like a clevis 242 and pin 244 for pivotally coupling the rod 240 to the roller member. An air over oil cylinder suitable for this application is Model No. AOJ1233A1, available from Mosier Industries, Inc., Brookville, Ohio.

According to one aspect of the fluidic circuit 200, the rod 240 of the cylinder 210 is extendable and retractable by supplying air to the air cylinder portion 220 from an air supply through first and second air valves 260 and 270, respectively, which are actuatable by solenoids. More particularly, the first air valve 260, which is normally closed, is opened to supply air to a first port 224 to extend the rod 240 thereby biasing the corresponding roller member toward the mandrel 20. And, alternately, the second valve 270, which is also normally closed, is opened to supply air to a second port 226 to retract the rod 240 thereby moving the corresponding roller member away from the mandrel. Air is thus the primary actuator of the rod 240.

According to another aspect of the fluidic circuit 200, the first and second roller members 110 and 120 are retractable away from the mandrel 20 to accommodate the sheet material wound increasingly thereabout. The power driven lay-on roll 130 also retracts as discussed above. The hydraulic cylinder portion 230 includes a fluid flow path from a first port 234 on one side of the hydraulic cylinder portion 230, through a flow control valve 280, and back to a second port 236 on the other side of the hydraulic cylinder portion 230. The flow control valve 280, which may be adjustable, restricts the flow of fluid between the first port 234 and the second port 236 thereby providing hydraulic resistance to the corresponding retracting roller member. The flow rate of the flow control valve 280 is adjusted to permit retraction of the roll member at a rate that will accommodate increasing amounts of sheet material wound about the mandrel 20, and at the same time provide sufficient hydraulic resistance to the retracting roller member to prevent or at least substantially reduce vibration of the rotating mandrel 20. During the retraction of the rod 240, air valve 260 remains opened to supply air to the air cylinder portion 220, and regulator 250 bleeds off excessive air pressure in the air cylinder portion 220 produced by the retracting rod 240.

According to another aspect of the fluidic circuit 200, a two-way check valve 290 is disposed between the first port 234 and the second port 236 in parallel with the flow control valve 280 for bypassing the flow control valve 280 during some operations. In one operation, it is desirable to move the corresponding roller member 110 or 120 away from the mandrel 20 without hydraulic resistance caused by the flow control valve 280, for example, to install a new film core 22 about the mandrel 20 and to remove a wound film roll therefrom. To accommodate this operation, the check valve 290 is opened to allow hydraulic fluid to flow freely through the check valve 290 from the first port 234 to the second port 236 during retraction of the rod 240, whereby most of the fluid bypasses the flow control valve 280. When the two-way check valve 290 is in the opened position, there is also free fluid flow through the check valve 290 from the second port 236 to the first port 234, whereby most of the fluid bypasses the flow control valve 280. In another operation, it is desirable to move the corresponding roller member 110 or 120 toward the mandrel 20 without hydraulic resistance caused by the flow control valve 280, for example, to position the roller member into contact with a new film core 22 about the mandrel 20 prior to a winding operation. To accommodate this operation, the check valve 290 is closed to allow hydraulic fluid to flow freely through the check valve 290 from the second port 236 to the first port 234 during extension of the rod 240, whereby most of the fluid bypasses the flow control valve 280. When the two-way check valve 290 is in the closed position, there is no fluid flow through the check valve 290 from the first port 234 to the second port 236, whereby all fluid must flow through the flow control valve 280.

According to a related aspect of the invention, the two-way check valve 290 is normally closed, whereby the rod 240 is extendable without hydraulic resistance from the flow control valve 280 by supplying air to the air cylinder portion 220 through air port 224. The two-way check valve 290 is opened, by application of a signal to a corresponding solenoid, when it is desirable to retract the rod 240 without hydraulic resistance from the flow control valve 280. In one embodiment, the solenoid for opening the check valve 290 is coupled electrically to the solenoid for opening the second air valve 270, which supplies air to the air cylinder portion 220 through the second port 226. Thus the same electrical signal that opens the second air valve 270 may also open the two-way check valve 290.

According to yet another aspect of the fluidic circuit 200, a normally closed by-pass valve 295 is also disposed between the first port 234 and the second port 236 in parallel with the flow control valve 280 for bypassing the flow control valve 280 and the two-way check valve 290 under certain operating conditions. More specifically, the by-pass valve 295 is a safety valve that opens under extreme pressure conditions, which may be adjustably predetermined. Such a condition may result from retraction of the rod 240 at an abnormal rate during the winding operation, which will occur, for example, if a foreign object is accidently drawn between the mandrel and the roller member. According to this aspect of the invention, the by-pass valve 295 opens to permit free fluid flow through the valve 295 from the first port 234 to the second port 236 without flow resistance from the flow control valve 280, thereby allowing relatively immediate retraction of the rod 240 and hence movement of the roller member away from the mandrel.

While the foregoing written description of the invention enables anyone skilled in the art to make and use what is at present considered to be the best mode of the invention, it will be appreciated and understood by anyone skilled in the art the existence of variations, combinations, modifications and equivalents within the spirit and scope of the specific exemplary embodiments disclosed herein. The present invention therefore is to be limited not by the specific exemplary embodiments disclosed herein but by all embodiments within the scope of the appended claims.

What is claimed is:

1. A system for controlling vibration of an axially rotatable mandrel useable for winding sheet material thereabout, the system comprising:

a first roller member rotatably contactable with at least one of the mandrel and sheet material wound about the mandrel, the first roller member movable away from the mandrel to accommodate increasing amounts of sheet material wound about the mandrel;

a second roller member rotatably contactable with at least one of the mandrel and sheet material wound about the mandrel, the second roller member movable away from the mandrel to accommodate increasing amounts of sheet material wound about the mandrel;

a third roller member rotatably contactable with at least one of the mandrel and sheet material wound about the mandrel, the third roller member movable away from the mandrel to accommodate increasing amounts of sheet material wound about the mandrel;

the first roller member, the second roller member and the third roller member arranged about the mandrel axis so that the mandrel and any sheet material wound about the mandrel is supportably captured therebetween;

the first roller member biasable toward the mandrel with pneumatic pressure from a first air over oil cylinder, the first roller member movable away from the mandrel against hydraulic resistance from the first air over oil cylinder, the second roller member biasable toward the mandrel with pneumatic pressure from a second air over oil cylinder, and the second roller member movable away from the mandrel against hydraulic resistance from the second air over oil cylinder, whereby the first roller member, the second roller member and the third roller member at least substantially reduce vibration of the rotatable mandrel.

2. The system of claim 1 further comprising a support member, the first roller member coupled to the support member by a first arm, and the second roller member coupled to the support member by a second arm.

3. The system of claim 2, the support member is a rotatable turret, the mandrel is one of first and second mandrels each rotatably coupled to the rotatable turret, and the first roller member, the second roller member and the third roller member form one of at least two substantially identical sets of first, second and third roller members supportably capturing a corresponding one of the first and second mandrels.

4. The system of claim 3, the third roller members are a common rotatably driven lay-on roll for rotatably surface driving the mandrel and any sheet material wound thereabout, whereby the rotatable turret is rotatable to position one of the first and second mandrels relative to the lay-on roll for rotatably surface driving the mandrel.

5. A system for controlling vibration of an axially rotatable mandrel useable for winding sheet material thereabout, the system comprising:

a first roller member rotatably contactable with at least one of the mandrel and sheet material wound about the mandrel, the first roller member movable away from the mandrel to accommodate increasing amounts of sheet material wound about the mandrel;

a second roller member rotatably contactable with at least one of the mandrel and sheet material wound about the mandrel, the second roller member movable away from the mandrel to accommodate increasing amounts of sheet material wound about the mandrel;

a third roller member rotatably contactable with at least one of the mandrel and sheet material wound about the mandrel, the third roller member movable away from the mandrel to accommodate increasing amounts of sheet material wound about the mandrel;

the first roller member, the second roller member and the third roller member arranged about the mandrel axis so that the mandrel and any sheet material wound about the mandrel is supportably captured therebetween;

a support member, the first roller member coupled to the support member by a first arm, and the second roller member coupled to the support member by a second arm;

a first cylinder coupled to the support member and having an extendable and retractable first rod coupled to the first arm, the first arm pivotally coupled to the support member and the first roller member pivotally coupled to the first arm, the first rod is extendable to bias the first roller member toward the mandrel and the first rod is retractable to move the first roller member away from the mandrel; and a second cylinder coupled to the support member and having an extendable and retractable second rod coupled to the second arm, the second arm pivotally coupled to the support member and the second roller member pivotally coupled to the second arm, the second rod is extendable to bias the second roller member toward the mandrel and the second rod is retractable to move the second roller member away from the mandrel, whereby the first roller member, the second roller member and the third roller member at least substantially reduce vibration of the rotatable mandrel.

6. A method for controlling vibration of an axially rotatable mandrel useable for winding sheet material thereabout, the method comprising steps of:

rotatably contacting at least one of the mandrel and sheet material wound about the mandrel with a first roller member movable away from the mandrel to accommodate increasing amounts of sheet material wound about the mandrel;

rotatably contacting at least one of the mandrel and sheet material wound about the mandrel with a second roller member movable away from the mandrel to accommodate increasing amounts of sheet material wound about the mandrel;

rotatably contacting at least one of the mandrel and sheet material wound about the mandrel with a third roller member movable away from the mandrel to accommodate increasing amounts of sheet material wound about the mandrel;

supportably capturing the mandrel and any sheet material wound about the mandrel between the first roller member, the second roller member and the third roller member to at least substantially reduce vibration of the rotatable mandrel;

rotatably coupling first and second mandrels to a rotatable turret;

supportably capturing each of the first and second mandrels with corresponding sets of first, second and third roller members arranged about the mandrel axis; and rotating the rotatable turret to position one of the first and second mandrels relative to the lay-on roll for rotatably surface driving one of the first and second mandrels and any sheet material wound thereabout.

7. The method of claim 6 further comprising steps of rotatably surface driving the mandrel with the third roller member operated as a lay-on roll.

8. A method for controlling vibration of an axially rotatable mandrel useable for winding sheet material thereabout, the method comprising steps of:

rotatably contacting at least one of the mandrel and sheet material wound about the mandrel with a first roller member movable away from the mandrel to accommodate increasing amounts of sheet material wound about the mandrel;

rotatably contacting at least one of the mandrel and sheet material wound about the mandrel with a second roller member movable away from the mandrel to accommodate increasing amounts of sheet material wound about the mandrel;

rotatably contacting at least one of the mandrel and sheet material wound about the mandrel with a third roller member movable away from the mandrel to accommodate increasing amounts of sheet material wound about the mandrel;

supportably capturing the mandrel and any sheet material wound about the mandrel between the first roller member, the second roller member and the third roller member to at least substantially reduce vibration of the rotatable mandrel;

biasing the first roller member toward the mandrel with pneumatic pressure from a first air over oil cylinder, and moving the first roller member away from the mandrel against hydraulic resistance from the first air over oil cylinder; and biasing the second roller member toward the mandrel with pneumatic pressure from a second air over oil cylinder, and moving the second roller member away from the mandrel against hydraulic resistance from the second air over oil cylinder.

* * * * *